US006516716B1

(12) United States Patent
Robertson et al.

(10) Patent No.: US 6,516,716 B1
(45) Date of Patent: Feb. 11, 2003

(54) METHOD AND APPARATUS FOR STAMP MARKING WITH VARIABLE INFORMATION

(76) Inventors: John A. Robertson, 683 Hilltop Ct., Chillicothe, OH (US) 45601; G. David Hudelson, 8847 Chateau Dr., NW., Pickerington, OH (US) 43147; Ken R. Vaughn, 7392 Dry Run Rd., Kingston, OH (US) 45644; Edward S. O'Neal, 22380 State Rte. 180, Rockbridge, OH (US) 43149

( * ) Notice: Subject to any disclaimer, the term of this patent is extended or adjusted under 35 U.S.C. 154(b) by 0 days.

(21) Appl. No.: 10/039,610

(22) Filed: Nov. 9, 2001

(51) Int. Cl.[7] ..... B41F 17/00

(52) U.S. Cl. ..... 101/41; 101/163; 101/170; 101/492; 430/258

(58) Field of Search ..... 101/41, 163, 170, 101/483, 487, 488, 492, 42, 333, 368, 379; 427/146, 554, 555, 556, 557

(56) References Cited

U.S. PATENT DOCUMENTS 4,905,594 A * 3/1990 Phillip et al. ..... 101/163
5,401,616 A * 3/1995 Isomi et al. ..... 430/258
5,422,167 A * 6/1995 Robertson et al. ..... 428/195
5,694,847 A * 12/1997 Kleist ..... 101/170
5,855,969 A * 1/1999 Robertson ..... 427/555

* cited by examiner

*Primary Examiner*—Andrew H. Hirshfield
*Assistant Examiner*—Jill E Culler
(74) *Attorney, Agent, or Firm*—Mueller and Smith, LPA

(57) ABSTRACT

A method for imaging a product with a pattern commences by forming a film of a wet or tacking marking material on a cliché. A negative of the pattern is ablatively imaged into the film on the cliché. The negative image then is pressure transferred from the cliché onto a marking pad. Finally, the negative image is pressure transferred from the marking pad onto the product. Preferably, the cliché where the film is formed contains recesses. The apparatus, which images the product, has a moveable cliché having a recessed pocket. An ink reservoir transfers ink into the recessed pocket. A laser imaging system images a pattern into ink contained in the recessed pocket. A stamp pad is moveable from a home position to contact the imaged pattern for pressure transferring the pattern onto the stamp pad, and moveable to a printing station to pressure transfer the pattern onto a product.

16 Claims, 4 Drawing Sheets

METHOD AND APPARATUS FOR STAMP MARKING WITH VARIABLE INFORMATION

CROSS-REFERENCE TO RELATED APPLICATIONS

None

STATEMENT REGARDING FEDERALLY SPONSORED RESEARCH

Not applicable.

BACKGROUND OF THE INVENTION

The present invention generally relates to product marking and identification and more particularly to a much improved industrial stamp pad printing system.

There is a need to piece identify many products with variable (changeable) information. Pad printing such products with an ink pattern is a proven low cost, aesthetically pleasing marking technique, which produces high contrast, durable marks. Unfortunately, the markings provided by traditional pad printed markings are difficult and/or slow to change, because they create the image using either an etched pattern in a cliché or a pre-formed stamp. Increasingly, there is an identified need to produce unique stamped ink indicia upon each product piece and to change the indicia pattern quickly.

As an example as to how conventional stamp pad printing techniques work, reference is made to U.S. Pat. No. 4,905,594. In particular, FIG. 7 of this patent is reproduced as FIG. 1 herein. A silicone rubber pad, 72, is used to imprint a product (not shown) when it is in a lowered position. The image to be imprinted is etched into a cliché plate, 69, at a surface, 70, which retains ink from a reservoir, 1, when it is extended to the leftmost position (dashed lines). Pad 72 then lowers to pick up the ink resident in the etched area, the cliché is retracted, and pad 72 then extends to the bottommost position to apply the image onto the product.

Cliché plate 69 must be changed if the ink pattern is to be changed. This is a time consuming, manual process, because ink reservoir 1 must be manually removed (clamped and inverted as is detailed in U.S. Pat. No. 5,694,847) prior to changing cliché plate 69. This process, then, must be reversed to install a new cliché plate bearing a new image.

Thus, there exists a need in the art for a stamp marking apparatus wherein the pattern can be changed rapidly and easily so that variable on demand information can be imprinted. It is to such a need that the present invention is addressed.

BRIEF SUMMARY OF THE INVENTION

A method for imaging a product with a pattern commences by forming a film of a wet or tacking marking material on a cliché. A negative of the pattern is ablatively imaged into the film on the cliché. The negative image then is pressure transferred from the cliché onto a marking pad. Finally, the negative image is pressure transferred from the marking pad onto the product. Preferably, the cliché where the film is formed contains recesses.

The apparatus for practicing the instant method has a moveable cliché having a recessed pocket. An ink reservoir transfers ink into the recessed pocket. A laser imaging system images a pattern into ink contained in the recessed pocket. A stamp pad moves from a home position to contact the imaged pattern for pressure transferring the pattern onto the stamp pad, and then moves to a printing station to pressure transfer the pattern onto a product.

Advantages of the present invention include the ability to pressure print products rapidly. Another advantage is the ability to vary the pattern easily without interrupting the production line. These and other advantages will be apparent to those skilled in the art based on the disclosure set forth herein.

BRIEF DESCRIPTION OF THE DRAWINGS

For a fuller understanding of the nature and advantages of the present invention, reference should be had to the following detailed description taken in connection with the accompanying drawings, in which:

FIG. 2 shows the cliché plate bearing a recessed pocket and ink reservoir directly above;

FIG. 3 shows the cliché plate moved to the left for imaging by a laser;

FIG. 4 shows the cliché plate moved further to the left wherein the image on the cliché is transferred to the stamp pad;

FIG. 5 shows the cliché plate returned to its home position and the stamp pad being extended downwardly to print a product; and FIG. 6 shows the image being transferred from the stamp pad onto the product.

The drawings will be described in greater detail below.

DETAILED DESCRIPTION OF THE INVENTION

Because the pattern to be imprinted on the product is laser imaged each time, the pattern can be altered each time that a new product arrives at the printing station. Alternatively, the flexibility of the invention permits the same pattern also to be marked on each product.

Figure 1:
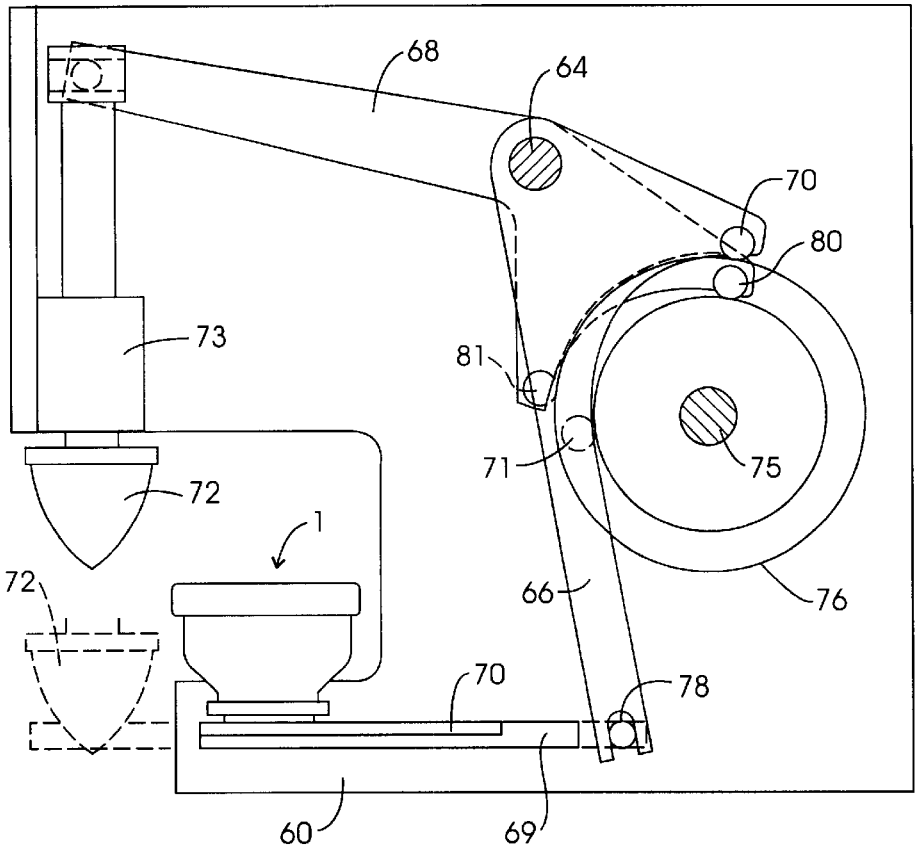
FIG. 1 PRIOR ART
FIG. 1 is a reproduction of FIG. 7 of U.S. Pat. No. 4,905,594.
Figure 2:
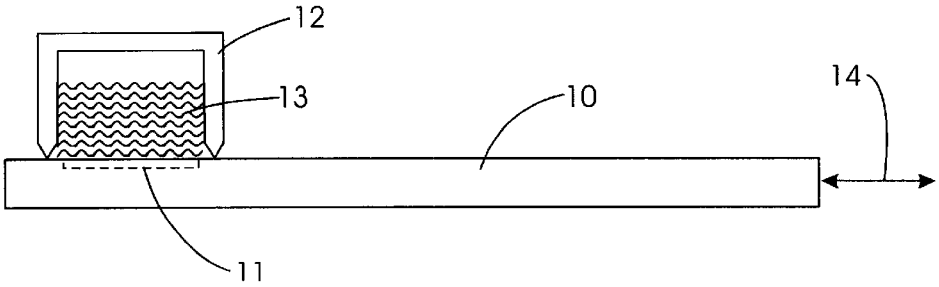
FIGS. 2–6 show in simplified plan view the sequence of steps practiced in accordance with the present invention, where.

Referring initially to FIG. 2, a cliché plate, 10, is seen at its ink reservoir station. Cliché plate 10 has a recess, 11, disposed beneath an ink reservoir, 12, which holds ink, 13. Pocket 11 suitably is cut into cliché 10 and can range from about 0.001 to 0.005 inches deep. The depth of pocket 11 corresponds to the wet thickness of the pattern that will be imprinted onto a product. Pocket 11 preferably has a plurality or an array of (small) indentations or recesses in order to suppress ink 13 from re-flowing after it is laser ablated.

Cliché 10 also is laterally movable by an actuator, 14, the details of which are not shown in the drawings. Actuator 14 can be one of a variety of conventional mechanisms ranging from stepper motors, to hydraulic pistons, etc. Actuator 14 is to be provided in conventional fashion. It is only important that cliché 10 is moveable from a ink reservoir station to a laser imaging station to a stamp pad transfer station and back again, as will be described in connection with the remaining drawings.

Figure 3:
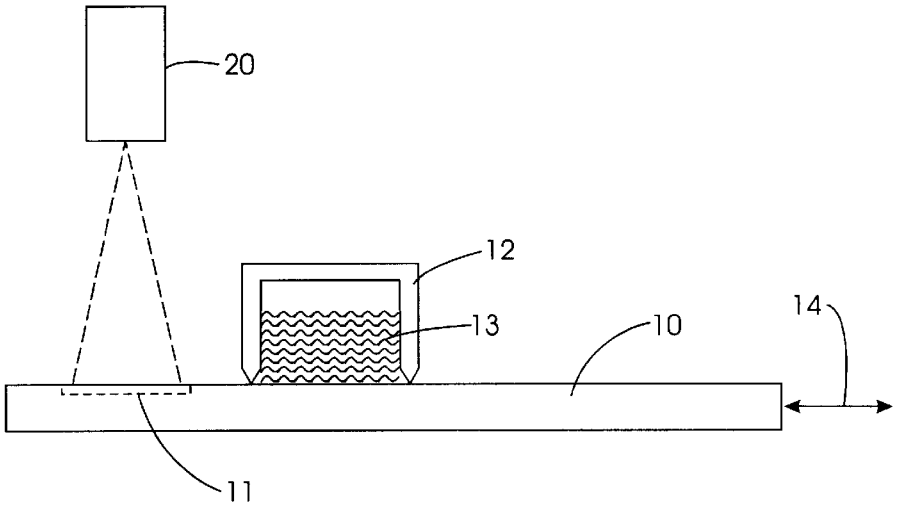

In FIG. 3, cliché 10 has been moved to a laser imaging station by actuator 14, whereat a laser, 20, ablatively images a pattern into the thin film of ink 13 resident in pocket 11 in cliché 10. Any suitable laser can be used to ablate ink from pocket 11 to form a pattern, including a $CO_2$ laser, a YAG laser, etc. The specific type of laser is not important, so long as it can ablate ink 13 in pocket 11 to form a pattern (e.g., alphanumeric characters, bar codes, graphics, and the like). Use of a raster scanning laser, such as is taught in U.S. Pat. No. 5,855,969 can be used to advantage in this step of the method.

Figure 4:
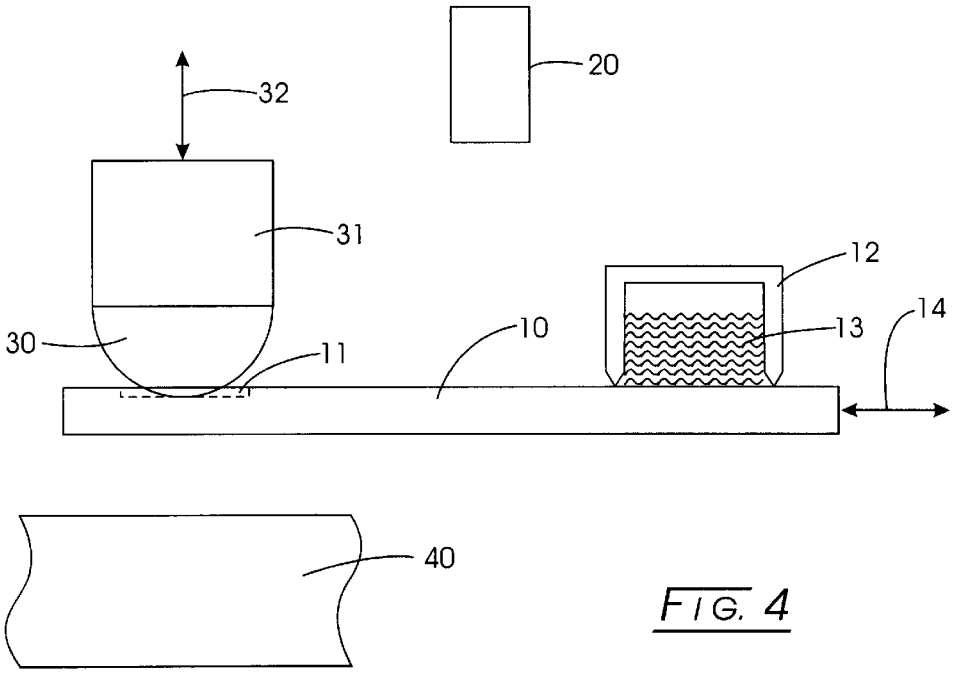

In FIG. 4, cliché 10 has been moved to an image transfer station by actuator 14, where the image is pressure transferred to a stamp pad, 30, (e.g., a silicone stamp pad), which is carried by a holder, 31. Holder 31 is moved vertically from an upper home station to a lower pressure transfer station, as illustrated in FIG. 4, by an actuator, 32, which can be the same as or different than actuator 14. The laser ablated image in pocket 11 is pressure transferred to silicone stamp pad 30. At this image transfer station, a product, 40, to be marked is seen located in vertical alignment with and below stamp pad 30. After the pattern has been transferred onto stamp pad 30, holder 31 is raised from contact with pocket 11 and cliché 10.

Figure 5:
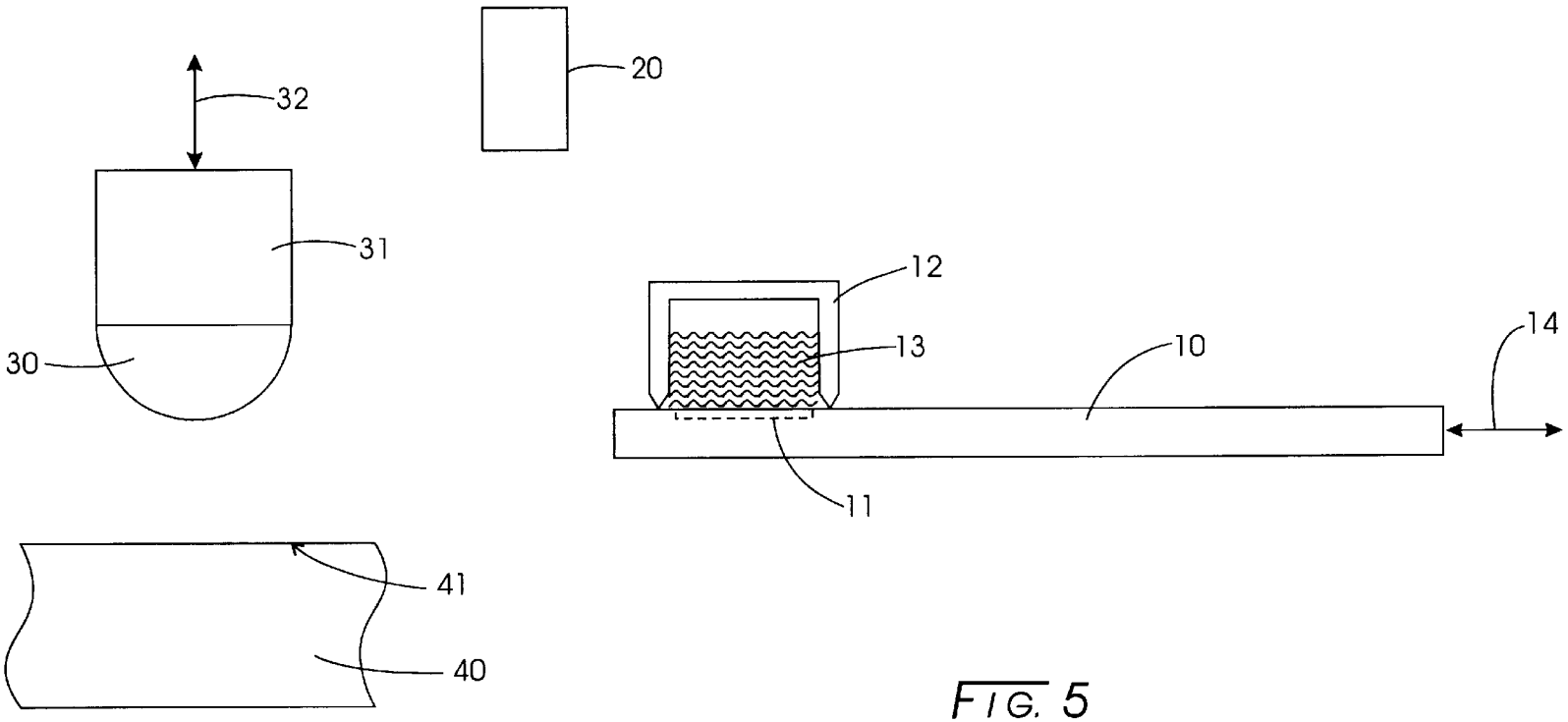
Figure 6:
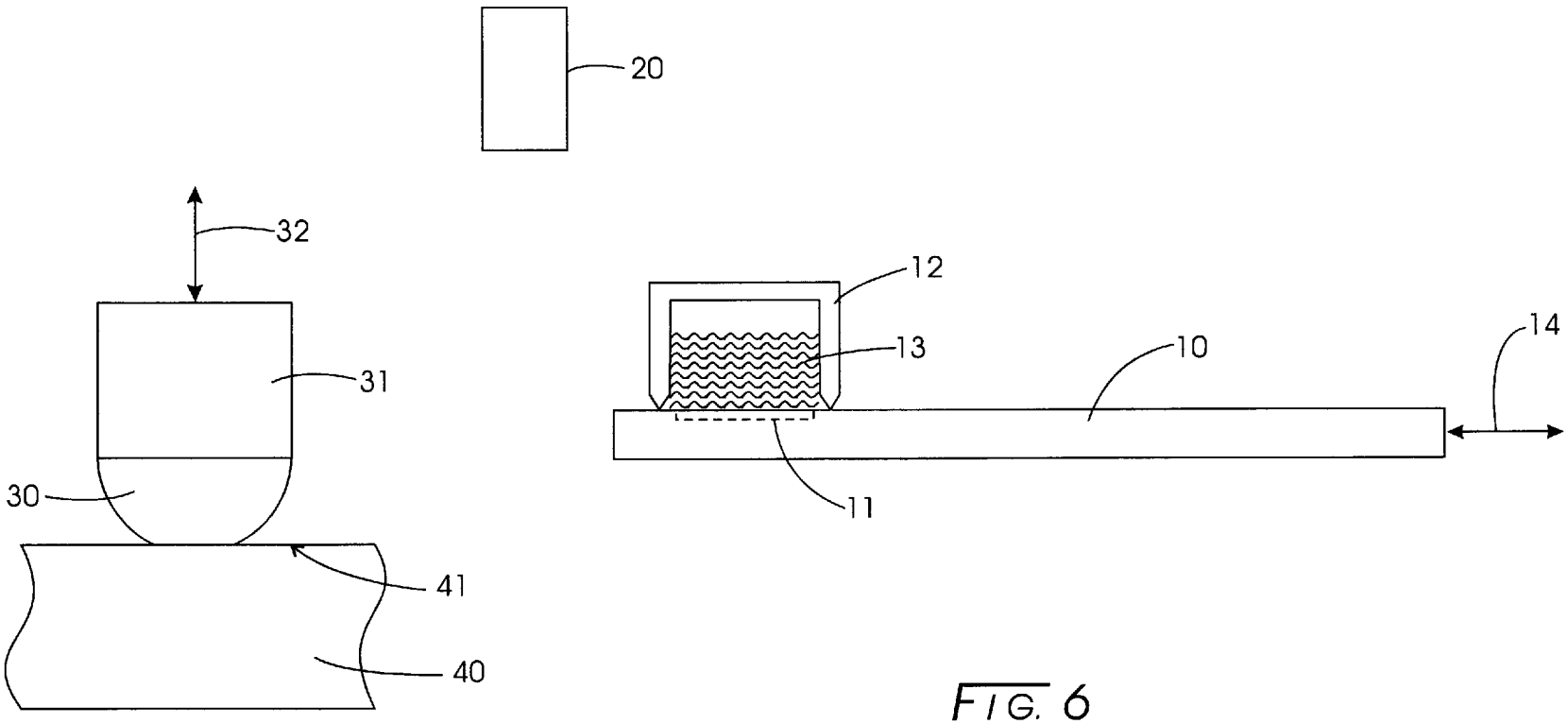

In FIG. 5, cliché 10 has been moved back to the ink transfer station by actuator 14. Such movement of cliché 10 exposes product 40 to stamp pad 30. In FIG. 6, then, actuator 32, moves holder 31 downwardly for pressure contacting silicone stamp pad 30 bearing the pattern onto a surface, 41, of product 40, whereby the pattern is transferred onto surface 41. Stamp pad 30, thus, is left clean for receiving another image when the method is repeated for the next item of product to be marked.

Ink 13 is any suitable ink that has a combination of solvent and/or resin (polymer) such that the ink remains wet or tacky in a thin film over the duration of the method, as described and illustrated in connection with FIGS. 2–6. Ink 13, can be ordinary print transfer ink or print transfer ink capable of withstanding high temperatures (see U.S. Pat. No. 5,422,167, for example). It only is important that the ink maintain its wet or tacky state during the duration of the present pressure printing method.

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In this application all units are in the metric system and all amounts and percentages are by weight, unless otherwise expressly indicated. Also, all citations referred herein are expressly incorporated herein by reference.

What is claimed is:

1. A method for imaging a product with a pattern, which comprises the steps of:

(a) forming a film of a wet or tacking marking material on a cliché;

(b) ablatively imaging a negative of the pattern into said film on said cliché;

(c) pressure transferring said negative image from said cliché onto a marking pad; and (d) pressure transferring said negative image from said marking pad onto said product.

2. The method of claim 1, wherein said cliché is moveable from an ink reservoir station for step (a) to a laser imaging station for step (b) to an image transfer station for step (c) and back to said ink reservoir station.

3. The method of claim 1, wherein steps (a) through (d) are repeatable.

4. The method of claim 1, wherein said pattern is ablatively imaged with a laser.

5. The method of claim 1, wherein said film in step (a) is formed in a recessed pocket in said cliché.

6. The method of claim 5, wherein said recessed pocket has an array of indentations for suppressing re-flow of said ink in said negative image.

7. The method of claim 5, wherein said marking pad moves vertically downward from a home station to contact said negative image in said cliché pocket in step (c), then upwardly away from said contact, said cliché is moved out from under said marking pad, and then said marking pad moves vertically downwardly to pressure transfer said negative image in step (d).

8. The method of claim 6, wherein:

said cliché is moveable from an ink reservoir station for step (a) to a laser imaging station for step (b) to an image transfer station for step (c) and back to said ink reservoir station; and said marking pad moves vertically downward from a home station to contact said negative image in said cliché pocket in step (c), then upwardly away from said contact, said cliché is moved out from under said marking pad, and then said marking pad moves vertically downwardly to pressure transfer said negative image in step (d).

9. The method of claim 1, wherein said marking pad is a silicone marking pad.

10. The method of claim 1, wherein said marking material is a printing ink.

11. An apparatus for imaging a product with a pattern, which comprises:

(a) a moveable cliché having a recessed pocket;

(b) an ink reservoir, which can transfer ink into said recessed pocket;

(c) a laser imaging system capable of imaging a pattern into ink contained in said recessed pocket;

(d) a stamp pad moveable from a home position to contact said imaged pattern for pressure transferring said pattern onto said stamp pad, and moveable to a printing station to pressure transfer said pattern onto a product.

12. The apparatus of claim 11, wherein said recessed pocket has an array of indentations for suppressing re-flow of said ink in said negative image.

13. The apparatus of claim 11, wherein said cliché is moveable laterally from an ink reservoir station to a laser imaging station to an image transfer station, and back to said ink reservoir station.

14. The apparatus of claim 13, wherein:

said stamp pad is movable vertically downward from a home station to contact said imaged pattern in said pockets, then upwardly away from said contact, said cliché is movable out from under said stamp pad, and then said stamp pad is movable vertically downwardly to pressure transfer said pattern.

15. The apparatus of claim 11, wherein said stamp pad is a silicone marking pad.

16. The apparatus of claim 11, wherein said stamp pad is movable vertically downward from a home station to contact said imaged pattern in said pocket, then upwardly away from said contact, said cliché is movable out from under said stamp pad, and then said stamp pad is movable vertically downwardly to pressure transfer said pattern.

* * * * *